US006773282B2

(12) United States Patent
Alvey

(10) Patent No.: US 6,773,282 B2
(45) Date of Patent: Aug. 10, 2004

(54) MODULAR TELEPHONE JACK FOR MULTI-OCCUPANT DWELLING

(75) Inventor: Stephen L. Alvey, San Angelo, TX (US)

(73) Assignee: Verizon Services Corp., Arlington, VA (US)

( * ) Notice: Subject to any disclaimer, the term of this patent is extended or adjusted under 35 U.S.C. 154(b) by 0 days.

(21) Appl. No.: 10/304,154

(22) Filed: Nov. 26, 2002

(65) Prior Publication Data

US 2004/0102071 A1 May 27, 2004

(51) Int. Cl.[7] ..... H01R 29/00

(52) U.S. Cl. ..... 439/170; 439/13; 439/676; 439/52

(58) Field of Search ..... 439/170, 171, 439/172, 173, 166, 676, 52, 53, 13, 20, 640, 17, 744, 628, 174, 62; 200/51.05, 51.06, 51.07

(56) References Cited

U.S. PATENT DOCUMENTS

| | | | | | |
|---|---|---|---|---|---|
| 3,848,223 | A | * | 11/1974 | Pechard | 439/637 |
| 4,370,010 | A | * | 1/1983 | Ordmandy | 439/174 |
| 4,743,999 | A | * | 5/1988 | Hames | 361/56 |
| 4,856,999 | A | * | 8/1989 | Flohr | 439/52 |
| 5,244,402 | A | * | 9/1993 | Pasterchick, Jr. et al. | 439/217 |
| 6,028,928 | A | * | 2/2000 | Mullaney et al. | 379/413.04 |
| 6,126,465 | A | * | 10/2000 | Franks, Jr. | 439/218 |
| 6,161,278 | A | * | 12/2000 | Easter et al. | 29/749 |
| 6,396,726 | B1 | * | 5/2002 | Austin et al. | 363/142 |

* cited by examiner

*Primary Examiner*—P. Austin Bradley
*Assistant Examiner*—X. Chung-Trans
(74) *Attorney, Agent, or Firm*—Leonard C. Suchtya, Esq.; Joel Wall, Esq.

(57) ABSTRACT

The disclosure is directed toward a Multi-Occupancy Dwelling (MOD) telephone jack for use where different telephone connections could be reconfigured without the need for a telephone technician. In the description herein, the term "jack" is used to describe a receptacle, whereas in the industry, a combination of a receptacle and a plug is sometimes called a jack. The MOD jack is similar to the regulation jack (RJ), or it could be a different connection point. The MOD jack has a plurality of selectable connecting points. The MOD jack includes a rotary dial. The rotary dial is connected to at least one connection point on a first plate and further a plurality of connection points on a second plate. The first plate is connected to a plurality of connection points. By rotating the rotary dial to a selected position, a connection may be made with one connection point, whereby a receptacle is connected to a set of lines, for example, a pair of tip and ring leads that could establish a telephone connection with a central office. In case of a T-1, VOIP or an ISDN connection, it is understood that a set of four, six, or eight wire connections could be made using the same arrangement.

In a further aspect, the disclosure is directed toward a modular MOD jack to connect a plurality of devices or service connections. These could be, for example, digital multiple line key phones, PABX extensions, data transmission units, fax machines, and signaling equipment.

20 Claims, 9 Drawing Sheets

MODULAR TELEPHONE JACK FOR MULTI-OCCUPANT DWELLING

TECHNICAL FIELD

This invention is directed in general toward communications interfaces, and in particular, toward a modular telephone connecting apparatus for a multi-occupant dwelling.

BACKGROUND

Multi-occupant dwelling units, such as an apartment or a dormitory room may have several individuals who would like to have their own telephone connection. Typically, in an apartment, each roommate may occupy a bedroom, and would like to have a private telephone connection to that room. When a new roommate takes up residence in an apartment, upon that roommate's request, a telephone service technician goes to that apartment and arranges telephone lines according to a requested configuration. This requires several trips to the place as new roommates join or leave the apartment, which is common during college "rush" days. Each such service technician's trip to a customer's location results in increased labor costs for a phone company. Additionally, the customer should wait until the technician configures the phone connection before the connection can be put to use. There is, therefore, a need to improve the art.

SUMMARY

In an aspect, this disclosure is directed toward a telephone jack for use in a multi-occupancy dwelling (MOD) or where different telephone connections could be reconfigured without the need for a telephone technician. In the description herein, the term "jack" is used to describe a receptacle, whereas in the industry, a combination of a receptacle and a plug is sometimes called a jack. The disclosed jack is similar to the regulation jack (RJ), or it could be a different type of connector.

In another aspect, the disclosed MOD jack has a plurality of selectable connecting points. The MOD jack includes a rotary dial. The rotary dial is connected to at least one set of connection points and further a plurality of connection receptacles. In an embodiment, the set of connection points is a set of gold-plated balls. By rotating the rotary dial to a selected position, a connection may be made with the set of connection points, whereby one of the plurality of connection receptacles is connected to a set of lines, for example, a pair of tip and ring leads that could establish a telephone connection with a central office. In case of a T-1, VOIP or an ISDN connection, it is understood that a set of four, six, or eight wire connections could be made using the same arrangement.

In a further aspect, the disclosure is directed toward a modular MOD jack to connect a plurality of devices or service connections. These could be, for example, digital multiple line key phones, PABX extensions, data transmission units, fax machines, and signaling equipment.

In a yet another aspect, the MOD jack can be configured using a method known to persons of ordinary skill in the art of making modular jacks such as RJ-11 or RJ-45 jacks. Using a selectable dial one may connect the MOD jack with telephone line equipment via wires running into term blocks. The selectable dial can be snapped into place once a selection is made, so that the selected configuration can be preserved until a change could be made to that configuration.

This selection and snapping in place is advantageously achieved by using spring loaded gold plated contacts with a friction-locking device between the rotary dial and the second plate. Other methods of creating such electrical connections are also contemplated.

BRIEF DESCRIPTION OF THE DRAWINGS

These and other features, objects and advantages of the present invention may be readily understood from the following detailed description illustrating the disclosed principles by way of some embodiments with reference to the accompanying drawings, where like numerals represent like parts in the several views, and wherein.

DETAILED DESCRIPTION

Figure 1:
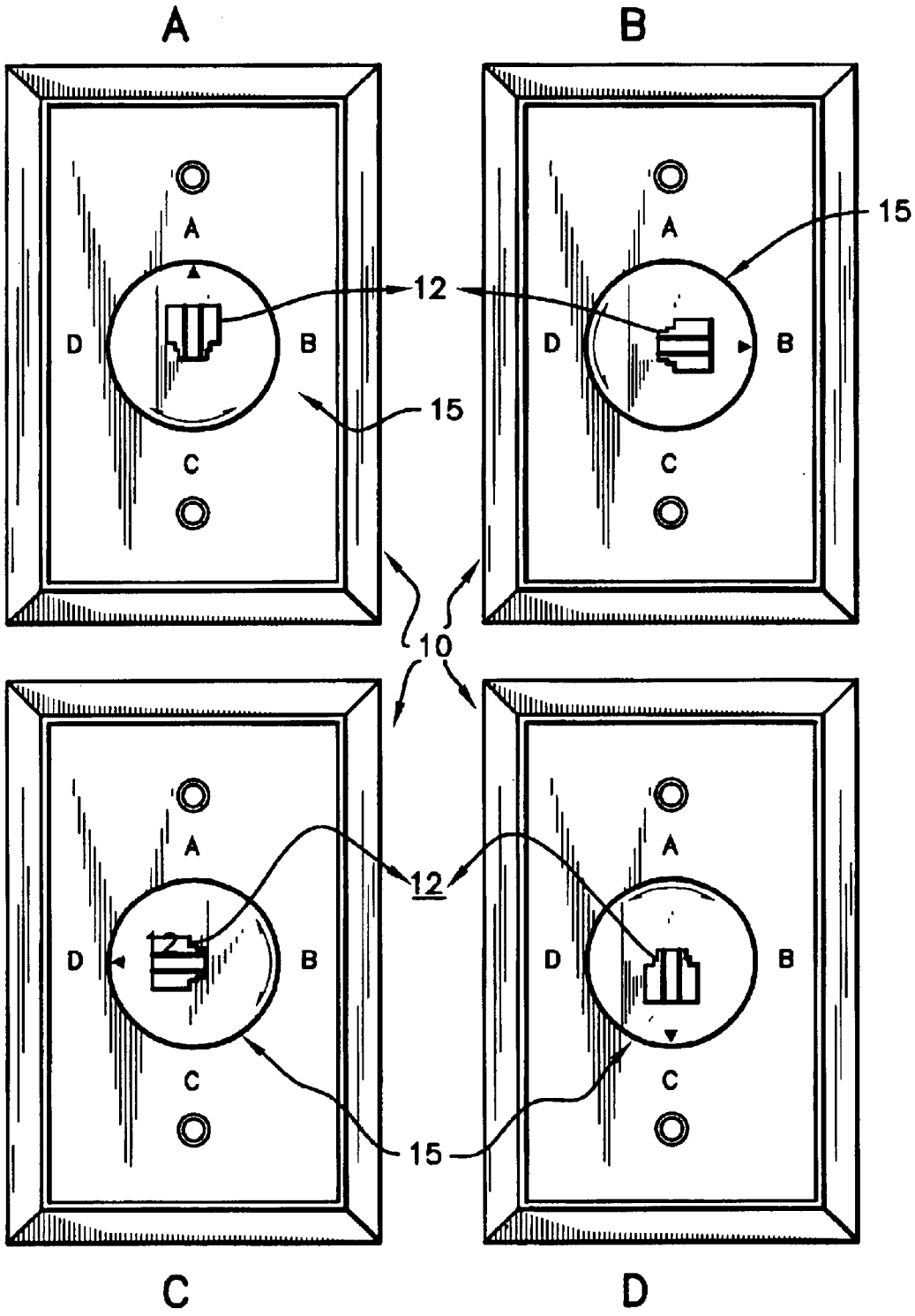
FIG. 1 shows four configurations of a front view of a MOD jack 10 in the shape of a wall outlet in a multi-occupant dwelling unit or a subscriber's premises that could support multiple POTS lines.

"Regulation Jack" is the term given to a telephony connection interface that has a receptacle (female) and a plug (male) as connectors. As stated above, the term "Jack" sometimes includes both the receptacle and the plug, but in this application, the term "Jack" is used only to describe the receptacle. It is understood, though, that a plug of suitable dimensions and design would be used to establish a telephone connection with a Customer Premise Equipment (CPE) device such as a telephone handset, a PBX, a modem, fax machine, data terminal, or other CPE devices.

RJ-11 and RJ-45 are the more common types of telephone jacks in use today. The RJ-11 jack is typically used in a household or office. The ordinary "untwisted" wire (sometimes called "gray satin" or "flat wire") of a telephone is typically connected to the RJ-11 jack. A standard computer modem is also typically connected to an RJ-11 jack. The RJ-11 jack, in turn, connects to the "outside" longer wires ("twisted pair") that connect to the telephone company central office (CO) or to a private branch exchange (PBX). The four wires are usually characterized as a red-and-green pair and a black-and-white pair. The red-and-green pair of wires typically carries voice or data. On an outside phone company connection, the black and white pair may be used for low-voltage signals such as phone lights. On a PBX system, they may be used for other kinds of signaling.

An RJ-14 jack is similar to the RJ-11, but the four wires are used for two phone lines. Typically, one set of wires (for one line) contains a red wire and a green wire. The other set contains a yellow and black wire. Each set carries one analog "conversation" (voice or data).

An RJ-45 jack is a single-line jack for digital transmission over ordinary phone wire, either untwisted or twisted. The interface has eight pins or positions. For connecting a modem, printer, or a data PBX at a data rate up to 19.2 Kbps, untwisted wire may be used. For faster transmissions, a twisted wire pair must be used.

In all the above configurations, each RJ jack contains a receptacle, inside which is a set of spring contacts. These spring contacts are connected to a corresponding set of pins (terminals) on the jack, which may be soldered, for example, to a circuit board. The receptacle receives a plug of a cable. The plug has a corresponding set of contacts, each connected to a corresponding conductor of the cable. Thus, by plugging in the plug of the cable into the receptacle of the RJ jack, the spring contacts of the receptacle come into electrical contact with the corresponding contacts of the plug. Thus, a device at the other end of the cable can be connected to a device electrically connected to the terminals of the circuit board. This permits easy connection or disconnection of elements, to make or break a circuit or path.

The present invention provides an interconnection device with improved interconnect and patch functionality. In an aspect, it has been discovered that by adding a rotating function, a standard jack such as an RJ family jack receptacle can be modified, resulting in a configurable jack that could be used in multi-occupancy dwellings. It should be noted that though the term "dwelling" is used in the description herein, the disclosed apparatus may be used in offices or other non-dwelling places, and therefore its use should not be limited to a dwelling or a Living Unit (LU).

Referring to the drawings, FIG. 1 shows four configurations of a front view of a MOD jack 10 in the shape of a wall outlet in a multi-occupant dwelling unit or a subscriber's premises that could support multiple POTS lines. Shown on the MOD jack 10 is a receptacle 12 to receive a telephone connection.

A, B, C and D indicate the positions or orientations of the receptacle 12 as it is rotated to establish a different telephone connection. The receptacle 12 is, in an embodiment, an RJ type jack and has characteristics similar to a conventional RJ jack. A set of spring contacts and a set of pins (not shown in FIG. 1) are also provided. Note that the MOD jack has a rotary function. This is achieved by way of a rotary dial 15 that can be rotated in order to configure which one of the positions A, B, C or D receives an inserted male plug (not shown in FIG. 1). The four configurations in which the unit could be arranged are labeled A, B, C and D. An arrow 20 on rotary dial 15 indicates the particular configuration of the wall outlet 10.

Note that the male and female plugs are interchangeable. Further, there could be other types of connectors, and the types of the connectors used in this description are only for illustration and not as a limitation of the principles described.

Figure 2:
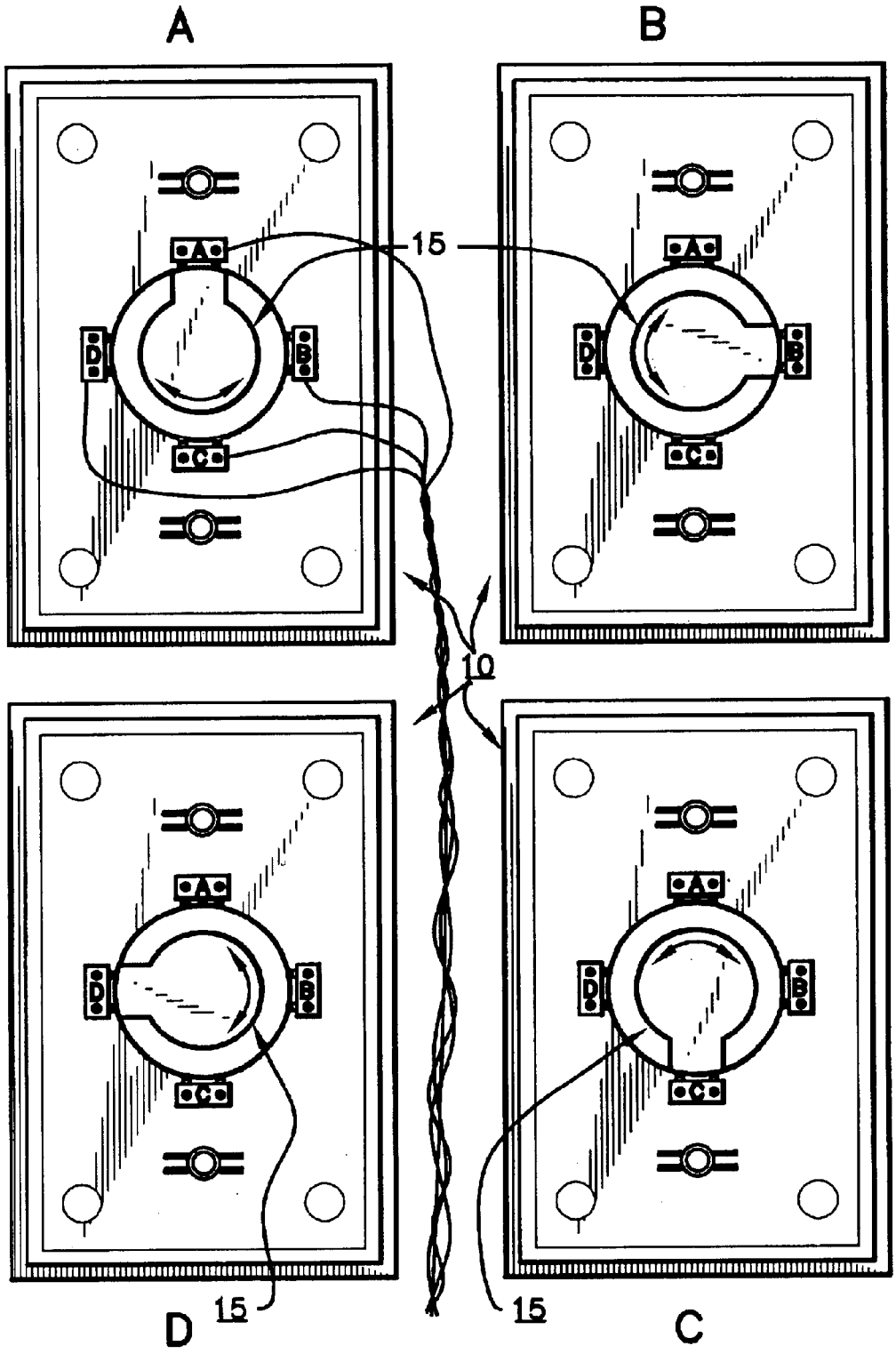
FIG. 2 shows a rear view of the MOD jack 10 for each of the four configurations of FIG. 1.

FIG. 2 shows a rear view of the MOD jack 10 for each of the four configurations of FIG. 1. Shown in FIG. 2 are four two-pair wire connections from each of the positions A, B, C and D. Each of the four two-pair connections is connected to a different device or office equipment on another side (not shown.) Depending on the orientation of the receptacle 12 when it receives a male plug (not shown in FIG. 2), a different connection will be established with the central office (CO) or other equipment on the opposite end of the connection. Thus, by suitably rotating the dial 15 to a chosen orientation, a different telecommunication connection may be established via the MOD jack 10.

Figure 3:
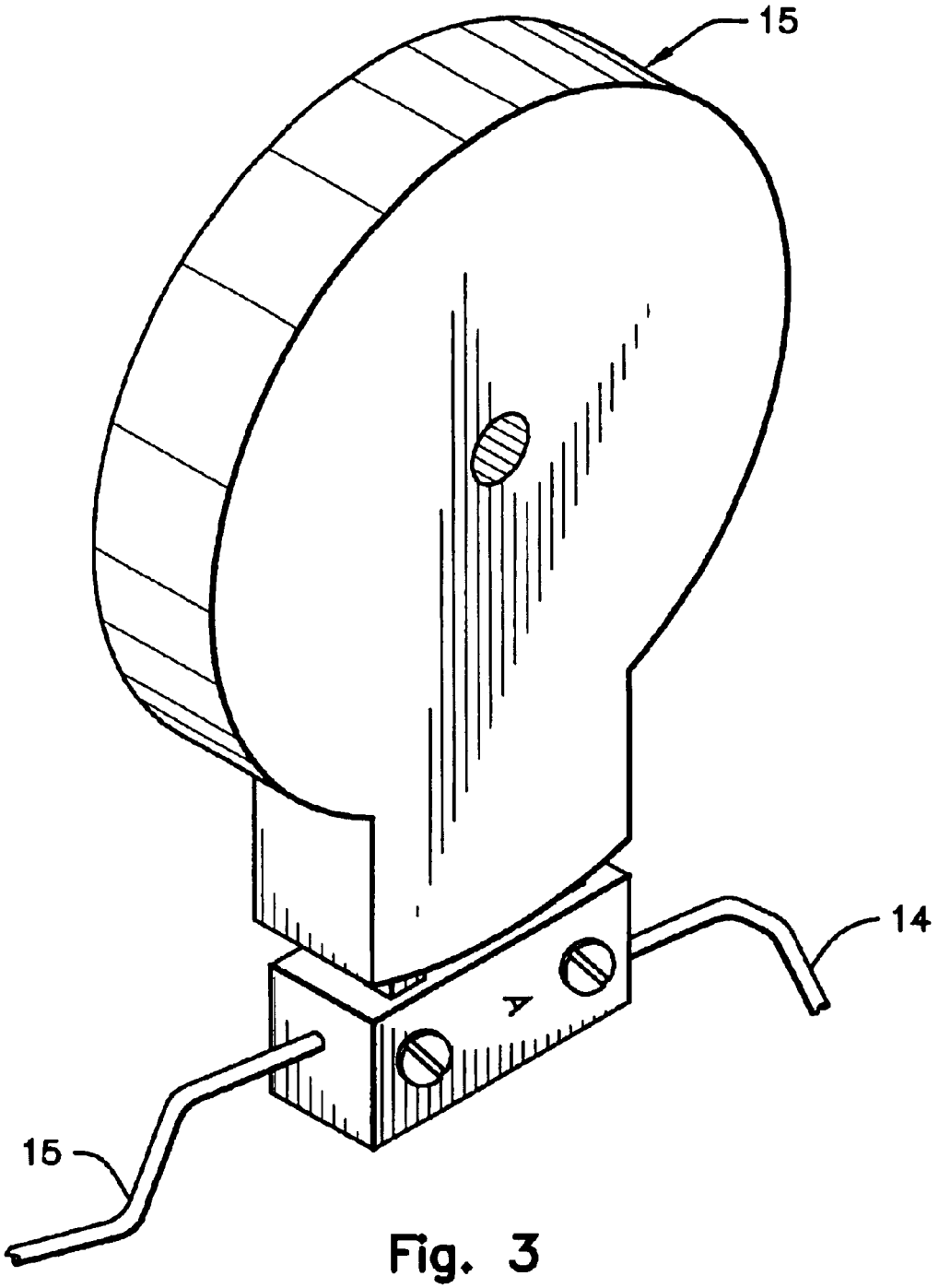
FIG. 3 shows a more detailed rear view of the rotary dial 15 as it is oriented toward position A of FIG. 1.

FIG. 3 shows a more detailed rear view of the rotary dial 15 as it is oriented toward position A of FIG. 1. The rotary dial 15 is advantageously made of an insulating material, except for those conducting portions as described herein. Of course, if the conducting portions are insulated, then the rotary dial need not be of any insulating material. Two wires covered in insulating sheath, for example, form Tip and Ring 14 and 15 respectively, and are connected to electrical contacts that terminate in a receptacle 12 for the position A. Note that the insulating sheath is removed at the end points where the wires 14 and 15 are to make electrical contact with metallic portions of the remaining circuitry, and persons of ordinary skill in the art readily know this.

Shown in FIG. 3 is an insulated housing 16 that forms an upper portion of the rotary dial 15. The MOD jack 10 contains at least first and second sets of pins 21, 22 which can be connected to form an electrical connection by way of the receptacle 12 (not shown in FIG. 3). When a plug (not shown) is inserted into the receptacle 12, electrical contacts (not shown) in the receptacle 12 and corresponding contacts in the plug are coupled, thus providing a path between the receptacle 12 and the plug to the Tip and Ring wires 14 and 15. This is possible only when the rotary dial 15 is oriented toward the position A. When the rotary dial is oriented toward position B, then a different set of Tip and Ring wires 14' and 15' would make an electrical contact with corresponding pins (not shown in FIG. 3) in the receptacle 12, thereby establishing a different connection.

Figure 4:
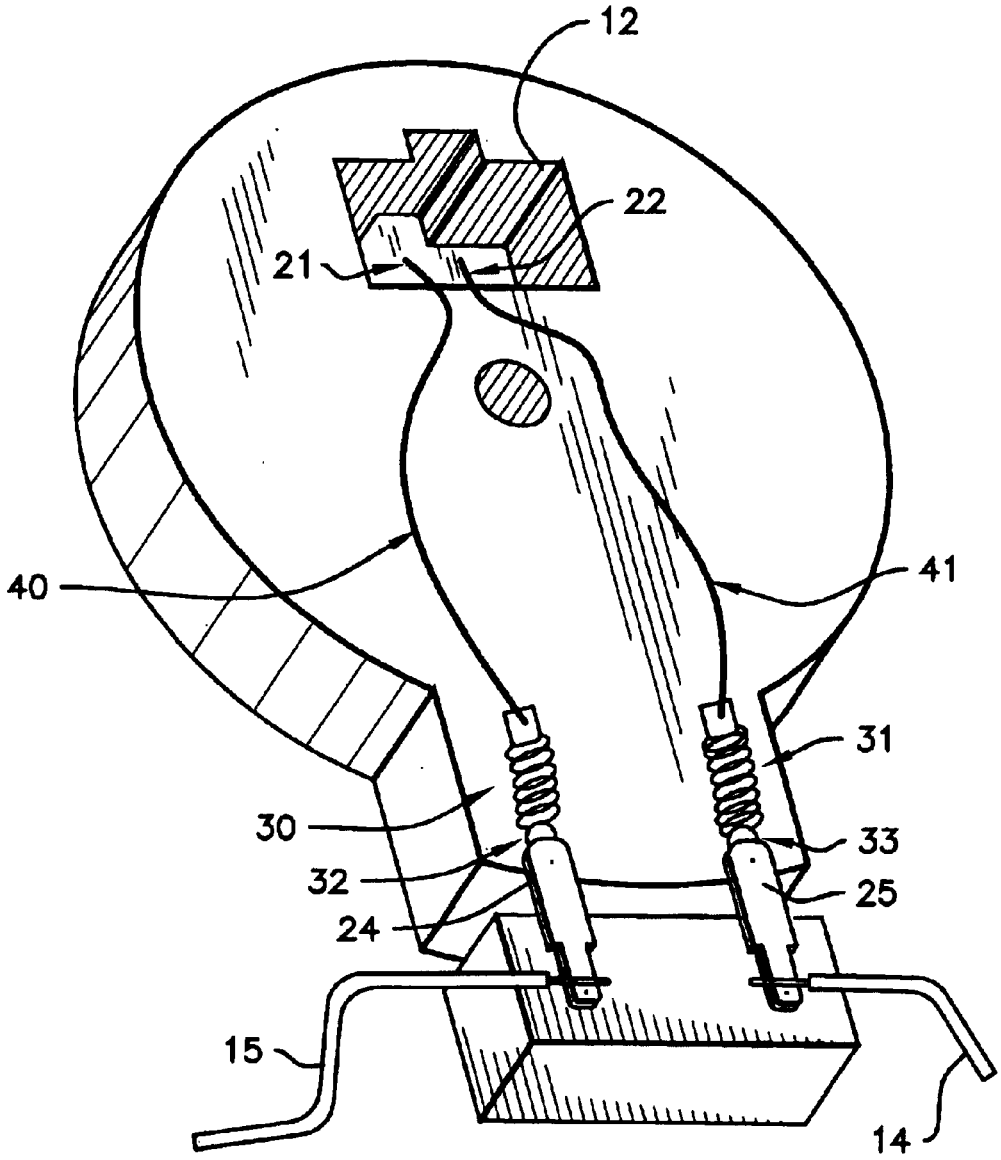
FIG. 4 shows an inside view of the rotary dial of FIG. 3.

FIG. 4 shows an inside view of the rotary dial of FIG. 3, detailing the interconnection when a connection is made in position A by suitably orienting the rotary dial 15. FIG. 4 shows two coiled springs 30 and 31, at a first end of each of which is a connection point (e.g., a set of gold plated balls 32, 33) for electric conduction upon contact.

Note that the term "connection point" refers to the set of connectors comprising the gold-plated balls 32, 33. This is different from the connection receptacle 12. It is easily understood that the connection point will have as many contact points as are needed to establish a connection such as a telephone connection. For instance, in the case of a two-wire connection, the connection point will have two contacts, such as a pair of gold-plated balls as described herein. In case of a four-wire connection, there will be four such contacts, and so on. The remaining of this description assumes a two-wire connection, but it can be readily appreciated that the description is not limited by the illustrated embodiment; rather, any connection, single wire, two-wire, three-wire, etc. connection may use the principles herein.

Two extension contacts 24 and 25 electrically extend the Tip and Ring wires 14 and 15. Two connectors 40, 41connect coiled springs to pins 21 and 22 of the MOD jack. It should be noted that the gold-plated balls 32, 33 could be made of any electric conducting material such as copper, aluminum or other similar metal. Spring coils 30, 31 provide a retractable contact surface between ends of tip and ring leads 24 and 25 and the gold-plated balls 32 and 33 respectively. When a plug (not shown) is inserted into the receptacle 12, contacts of the plug make electrical contact with corresponding spring coils via respective gold-plated balls, and thus, to the leads tip and ring. Note that the gold-plated balls provide for a connection with minimal friction so that repeated usage or rotation of the leads 24 and 25 over the gold plated balls 32 and 33 does not result in an excessive wear and tear.

Figure 5:
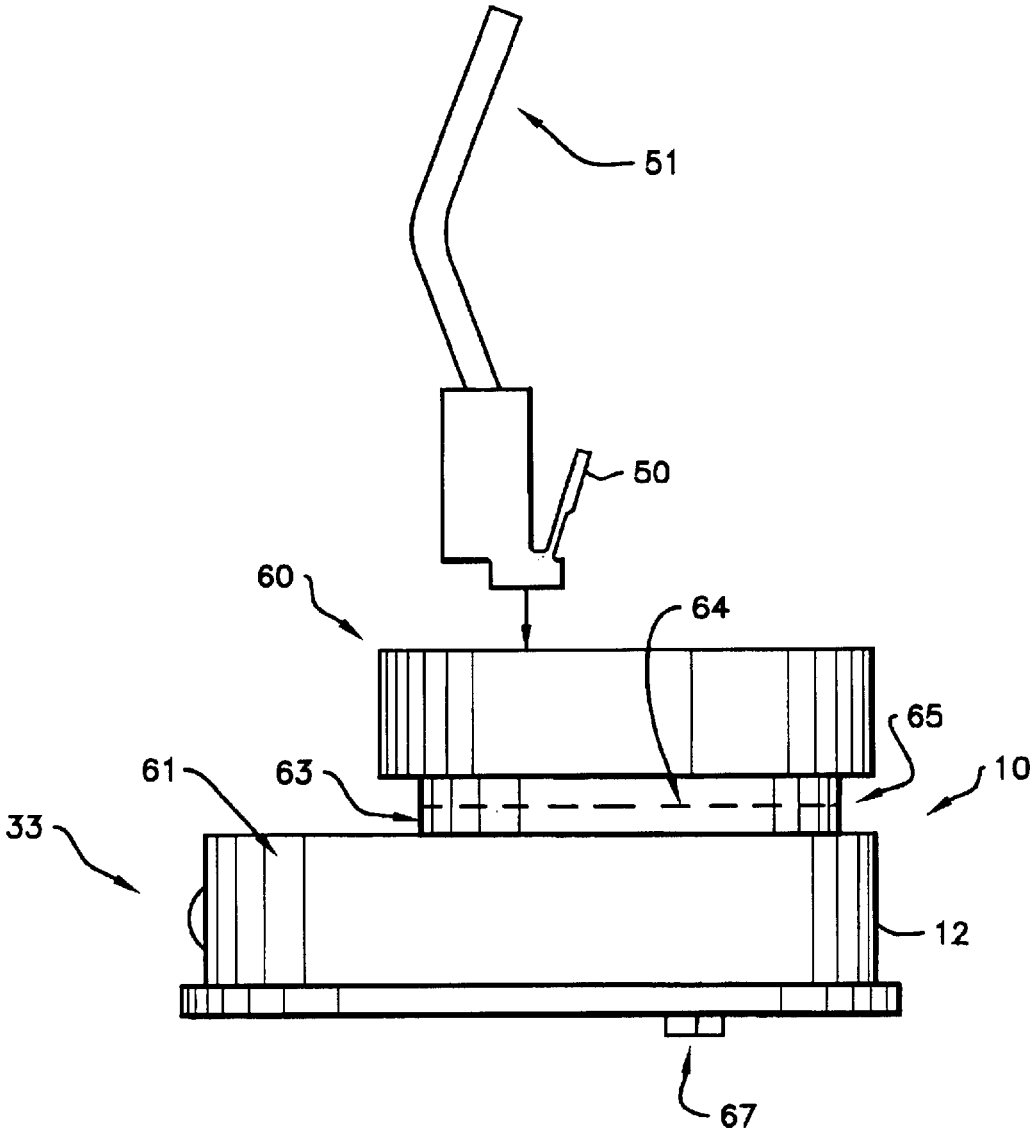
FIG. 5 shows a side view of the MOD jack 10 of FIG. 2.

FIG.5 shows a side view of the MOD jack 10 of FIG. 2, additionally showing a plug 50 connected to a line cord 51. The plug 50 is clamped to the line cord 51 using methods known to persons of skill in the art. The MOD jack 10 has two plates, an outer plate 60 and an inner plate 61. The two plates 61 and 62 are made of insulating material. The plates 61 and 62 have a substantially flat surface where the telephone connector receptacles are mounted to receive plug, and a substantially circular surface where the gold-plated balls are mounted to receive electric contact with a set of wires. The outer plate 61 has a recessed portion 63, which is of a smaller circumference compared to both the inner plate 61 and the outer plate 60. The outer plate 60 has a recessed portion 64 of a smaller circumference compared to the outer plate 60. The two recessed portions 63 and 64 abut each other to form a recessed space 65 between the outer plate 61 and the inner plate 62.

The recessed area 65 formed by recessed portions of plates 61 and 62 is configured to have a smaller circumference compared to either the outer plate 61 or the inner plate 62. The recessed area 65 forms a separator between the outer plate 61 and the inner plate 62, thereby allowing a rotation of one of the plates 61 or 62 with respect to the other along a common pivot. The two plates 61 and 62 are coupled together with a retaining clip 67. It should be noted that at least the outer plate 60 is capable of rotation with the retaining clip 67 as a pivot. In an embodiment, two plates 61 and 62 are capable of rotation together as a single unit, which rotation is with the retaining clip 67 as a pivot. Note that a gold-plated ball 33 is shown on the outer circumference of the inner plate 61.

Figure 6:
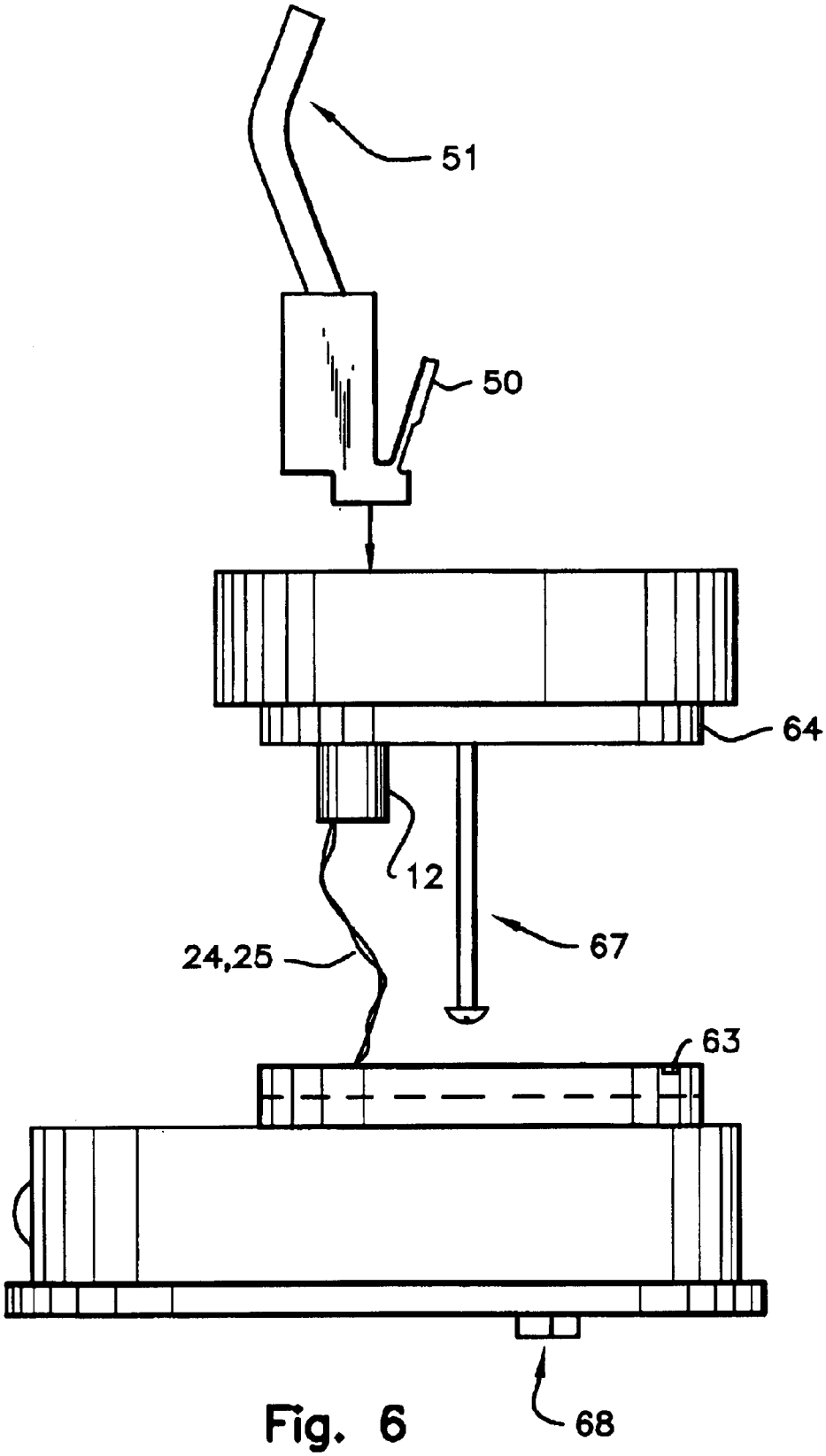
FIG. 6 shows a more detailed view of FIG. 5.
Figure 7:
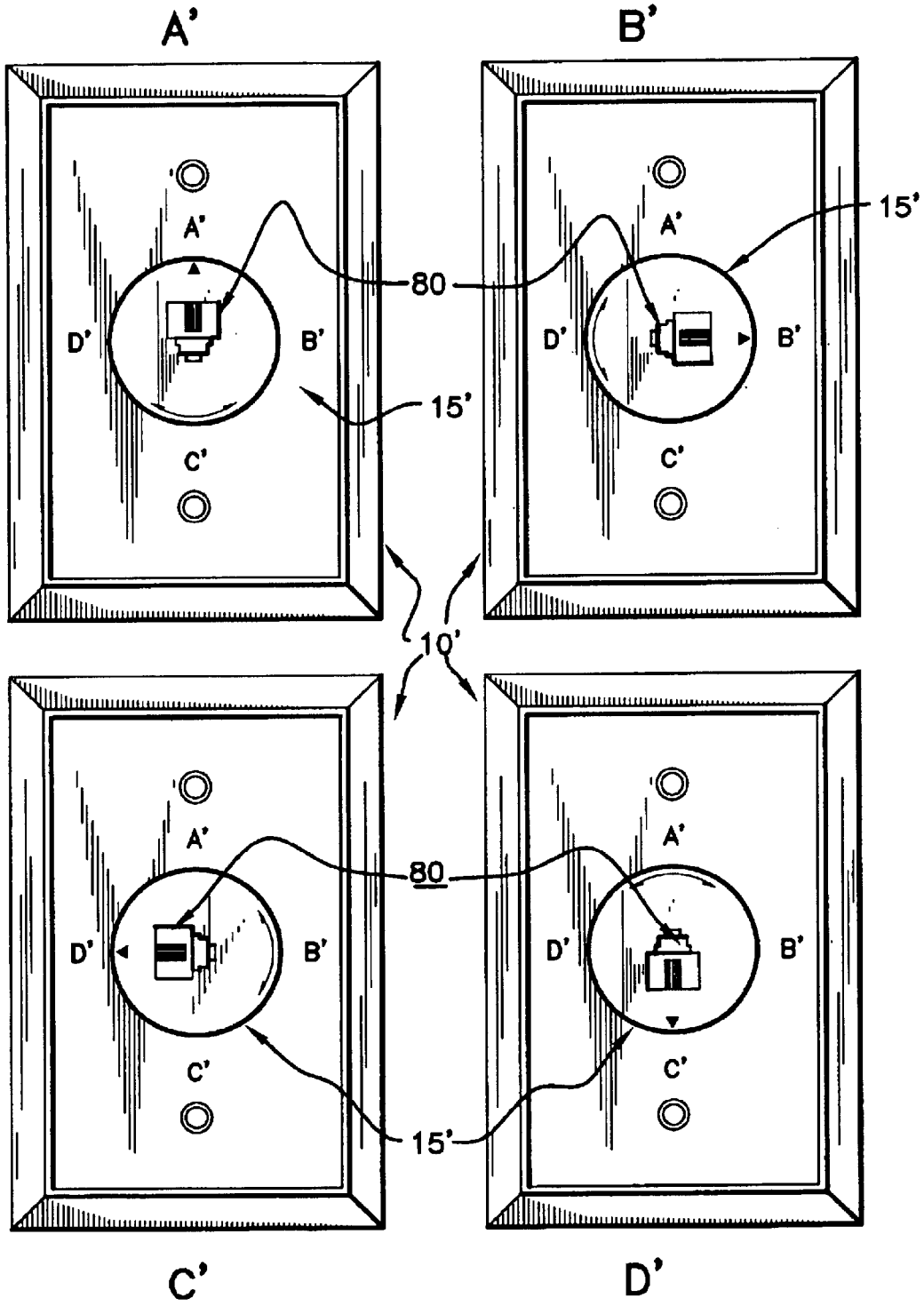
FIG. 7 shows a different view of FIG. 1, and depicts a male plug instead of a female connector.
Figure 8:
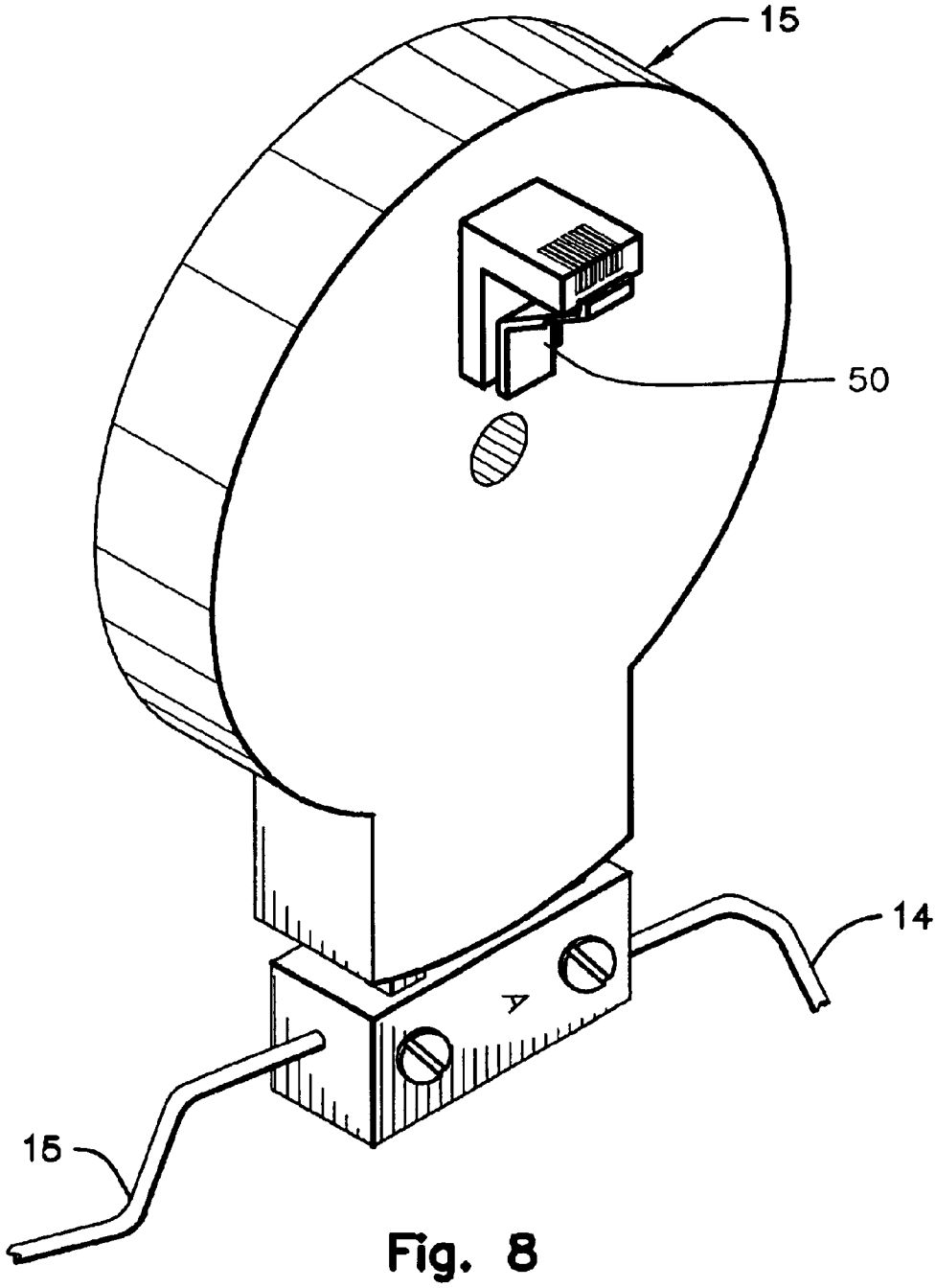
FIGS. 8 and 8' show different views of FIG. 4, and depict a male plug instead of a female connector.
Figure 8:
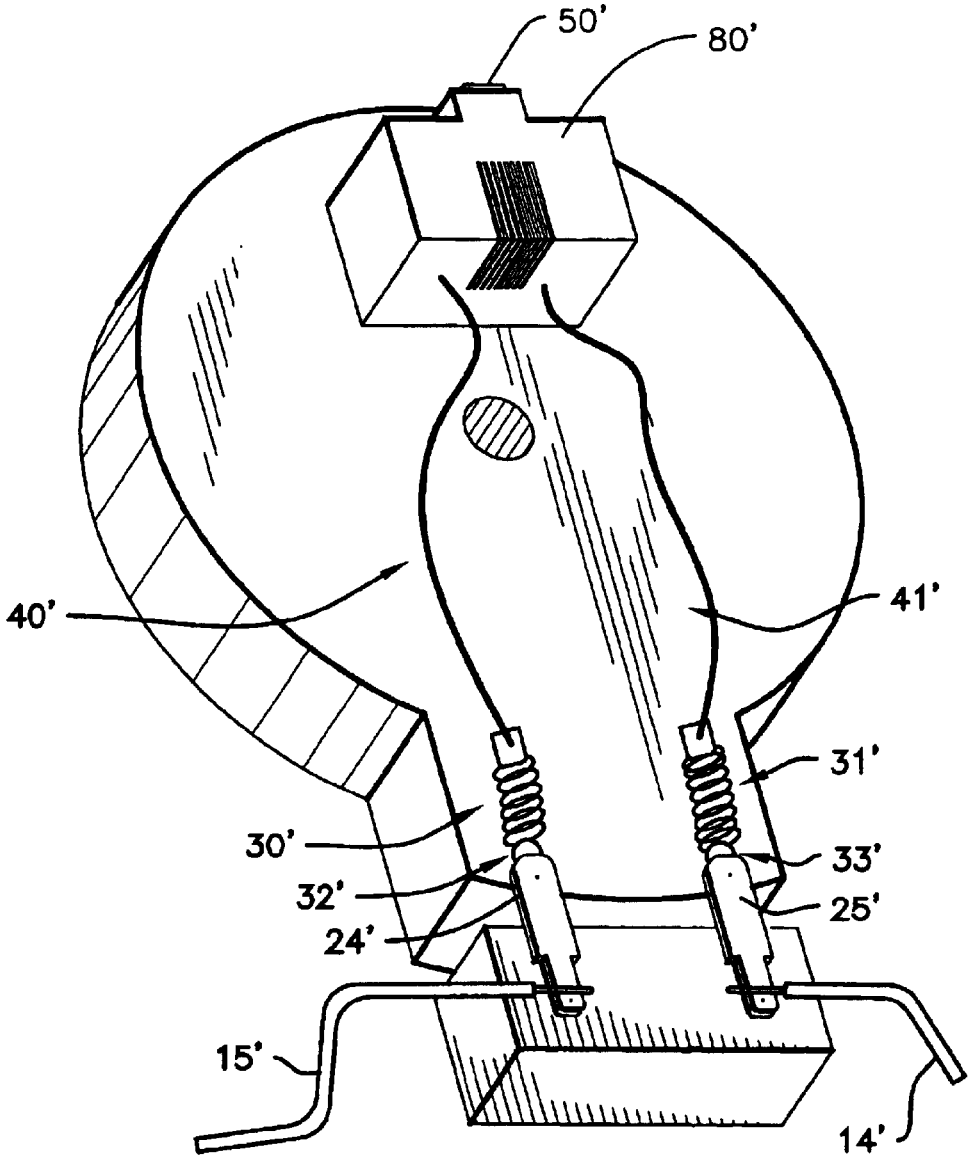

FIG. 6 shows a more detailed view of the rotary dial of FIG. 5, where the outer plate 60 and the inner plate 61 are separated, showing their inner construction. Into the outer plate 60 is provided the encasement for receptacle 12 which is suitably adapted to receive a plug 50 thereby forming an electrical path between a extension wires 24 and 25, which in turn, as explained above, connect the coiled springs to pins 30 and 31 of the MOD jack Tip and Ring respectively. Also shown again is one gold-plated ball 33 on the outer edge of the inner plate 61. It is understood that the gold-plated balls 33 and 32 (not shown in FIG. 6) are suitably adapted to make a frictionless contact with corresponding leads, thereby easily enabling the selection of a particular orientation and connection for the MOD jack 10. Retaining clip 67 is adapted to pass through hole 68 to clamp the plates 60 and 61 together. In alternative embodiments, the retaining clip 67 may be replaced with a bolt (with or without a nut), a screw, a rivet, or any other or similar mechanical fastening device is known to persons of ordinary skill in the art.

The MOD jack of the present disclosure provides one solution, applying user-friendly telephony functionality. The same principles can be applied to provide a number of users with different connections such as voice-over-IP, Ethernet, LAN, modem pool connections, fax connections and the like. The MOD jack module employing MOD or other RJ-type jacks can consist of 110-connectors (or wire-wrap pins) for connecting equipment cable and cross-connections and facilitate all patching of voice/DSO, DSI/T1, E1 and data/DSL signals. In alternative embodiment, an interconnect switch jack may be provided which is not based on the RJ jack family.

The foregoing describes an apparatus for providing flexible communication interface to a multi-occupant dwelling unit. It will be understood that various changes in the details, materials, and arrangements of the parts which have been described and illustrated above in order to explain the nature of this invention may be made by those skilled in the art without departing from the principle and scope of the invention. For example, the receptacles and the plugs can be interchanged without any departure from the inventive principles. All such departures are to be construed to be within the scope of the following claims.

What is claimed is:

1. A modular jack comprising:

a rotary dial;

a set of connection points mounted on a first surface of the rotary dial; and at least one connection receptacle mounted on a second surface of the rotary dial, wherein the set of connection points and the at least one connection receptacle are configured to establish at least one telephone connection be suitably rotating the rotary dial at least a part of a full rotation such that in a given position a desired telephone connection is established.

2. The modular jack of claim 1, wherein the dial is rotatable about an axis.

3. The modular jack of claim 1, wherein the dial is rotatable about a central axis.

4. The modular jack of claim 1, wherein the set of connection points comprises a set of gold-plated balls.

5. The modular jack of claim 1, wherein the connection receptacle is a regulation jack ("RJ") type connector.

6. The modular jack of claim 5, wherein the connection receptacle is an RJ-11 or RJ-45 connector.

7. The modular jack of claim 1, wherein the connection receptacle is adapted to receive a connection from Customer Premise Equipment.

8. The modular jack of claim 1, wherein the connection receptacle is a female connector.

9. The modular jack of claim 1, wherein the connection receptacle is a male connector.

10. The modular jack of claim 1, further comprising a plurality of sets of wires, each set capable of establishing a separate connection with a central office (CO).

11. A method of selecting one of a plurality of telephone connections at an outlet in a multi-occupancy dwelling (MOD), the method comprising the steps of:

terminating the plurality of separate telephone connections from a central office (CO) to a MOD jack; and rotating a portion of the MOD jack such that in a given position a selected telephone connection is established between the MOD jack and the CO.

12. The method of claim 11, wherein the MOD jack comprises at least one connection receptacle adapted to receive a connection from Customer Premise Equipment.

13. The method of claim 12, further comprising the step of:

establishing a connection between a set of connection points mounted on the MOD jack and the connection receptacle.

14. The method of claim 13, wherein the set of connection points comprises a set of gold-plated balls.

15. The method of claim 12, wherein the connection receptacle is a regulation jack ("RJ") type connector.

16. The method of claim 15, wherein the connection receptacle is an RJ-11 or RJ-45 connector.

17. The method of claim 12, wherein the connection receptacle is adapted to receive a suitable plug.

18. The method of claim 11, further comprising a plurality of sets of wire, each set capable of establishing a separate telephone connection.

19. The method of claim 11, wherein the connection receptacle is a female connector.

20. The method of claim 11, wherein the connection receptacle is a male connector.

* * * * *